United States Patent [19]

Venable

[11] 4,411,778

[45] Oct. 25, 1983

[54] APPARATUS FOR SCREENING GRAIN OR THE LIKE

[76] Inventor: D. L. Venable, 4110 11th Ave., Kearney, Nebr. 68847

[21] Appl. No.: 307,967

[22] Filed: Oct. 2, 1981

[51] Int. Cl.[3] ..... B07B 1/40

[52] U.S. Cl. ..... 209/246; 209/314; 209/356; 209/375

[58] Field of Search ..... 209/356, 314, 354, 353, 209/246, 370, 372, 375

[56] References Cited

U.S. PATENT DOCUMENTS

| | | | |
|---|---|---|---|
| 343,324 | 6/1886 | Kaspar | 209/356 |
| 470,681 | 3/1892 | Jewett | 209/356 |
| 608,049 | 7/1898 | Jessup | 209/356 |
| 1,168,282 | 1/1916 | Burgeson | 209/356 |
| 1,173,249 | 2/1916 | Burgeson | 209/356 |
| 1,185,595 | 5/1916 | Daly | 209/253 |
| 1,945,242 | 1/1934 | Walker | 209/356 |
| 2,203,152 | 6/1940 | Johnson | 209/356 |
| 4,231,861 | 11/1980 | Hannie et al. | 209/246 X |

*Primary Examiner*—Ralph J. Hill
*Attorney, Agent, or Firm*—Robert Newman

[57] ABSTRACT

An apparatus for cleaning grain and the like by gravity feeding through a casing having within it a central zig-zag chute with top-hinged screens resting across openings in each underside of each zig and each zag of the chute, the action of the grain itself resonating the screens for increased agitation. A large access door to the edge of the screens permits each inspection and replacement as the screens are hinged by means of a top strip which slides into an open-ended slot at the knee of each zig and each zag.

8 Claims, 3 Drawing Figures

APPARATUS FOR SCREENING GRAIN OR THE LIKE

BACKGROUND OF THE INVENTION

The present invention relates generally to apparatuses for cleaning grain and more particularly to gravity-fed apparatuses employing screens without having external vibrating means.

The notion of separating fines from clean grain by gravity feeding the material to be screened through a zig-zag path with the underside of each zig and each zag being a screen has long been recognized in the art, as is evidenced, for example, by U.S. Pat. Nos. 1,168,282; 1,173,249; 1,185,595; 1,945,242; and 2,203,152. While generally satisfactorily accomplishing their goal without the need for moving parts and accompanying machinery, such screeners had the common disadvantage of shortly becoming clogged with material such as broken pieces of grain without affording efficient and simple access to their interiors for cleaning, replacing screens and general maintenance. Hence, other configurations of screens which are mechanically vibrated or powered rotary screeners which tumble the material to be screened are frequently employed. By maintaining the grain or other material to be screened in a constant state of agitation, the clogging tendency is greatly reduced. While screens thus employed do not clog as quickly, a more complex and expensive piece of equipment is required, the separating action is less efficient and screen replacement is still somewhat difficult.

A rather popular type of gravity feeder which offers a solution to the screen cleaning and replacement dilemma, is in the form of a large gem having a silhouette in the shape of a diamond. The bottom half of the diamond is in the form of a large funnel having a square cross-section. The upper half of the diamond is identically shaped, but inverted, and has a smaller similarly shaped structure of screen material within it which is spaced away from its inner surfaces. This screen structure is connected at its bottom to a smaller solid walled lower half of what completes an interior diamond-silhouette structure, the bottom half of which is also spaced away from the bottom half of the exterior diamond-silhouette structure. The inverted funnel shaped screen is not open at its top and when grain enters at the top of the larger exterior structure, fines passing through the screen are caught by the interior lower solid wall structure and discharged through its bottom. Clean grain travels between the interior diamond-silhouette structure and the exterior diamond-silhouette structure through a discharge in the bottom thereof.

Such gravity-fed cleaners typically have, at their mid-sections, a square cross-section with sides 10 feet or longer in length. The smaller more compact gravity fed grain cleaners of the zig-zag chute type handle equivalent flow rates to those of the large diamond-silhouette type, primarily due to the increased agitation of the grain each time its flow path is abruptly altered by 90°. However, the diamond-silhouette type of gravity-fed grain cleaner is, of necessity, large enough a size that access to its interior structures for cleaning and replacing screens does not present a nearly impossible situation.

Nevertheless, a great deal more screen material and casing material is required to build the diamond-silhouette style grain cleaner than would be for prior art zig-zag cleaners and replacing screens is generally still a two man job requiring several hours of difficult labor. The present invention provides a cleaner which is materially more efficient than prior art zig-zag cleaners and, at the same time allows access for rapid screen replacement.

SUMMARY OF THE INVENTION

In the apparatus of this invention a casing is provided which has a central vertical zig-zag chute formed within it for receiving the gravity fed material to be screened. Screens are hinged above and cover openings on the underside of each zig and each zag of the chute. Cleaning or replacing screens is made simple by a large access door on the front wall of the casing and by the simple construction of the screens and the manner in which they are hinged above the openings. Each screen has a narrow top strip bent at 90° along one horizontal edge which is used to support the screen within an open-ended slot at the knee of each zig and zag. Thus, with the access door open, all screens may be removed and replaced in less than ten minutes by one person.

Also, greatly enhancing its efficiency as compared with the prior art gravity-fed zig-zag grain cleaners is the affect of the resonating action of each screen as it floats in a more or less hinged fashion about its supporting slot and above the underside of the zig or zag over which it is positioned. This floating and resonating action is, itself, a result of the effect of the bombardment of the many particles of grain as they pass through the zig-zag chute. This non-mechanically produced vibratory action of each screen enables the present invention to clean a materially greater flow of grain than prior art zig-zag chute cleaners. The present invention is capable of independently cleaning grain or the like, or being installed within a gravity flow system such as a commercial elevator, a terminal elevator for export shipping, a feed mill, or a food processing facility.

An object of the present invention is the provision of a zig-zag chute grain cleaner which agitates its screens without moving parts for enhancing its efficiency and for enabling its screens to self-clean.

Another object is to provide a grain cleaner in which screens may be quickly replaced by a single person.

A further object of the invention is the provision of a grain cleaner flow regulator with a cleaner by-pass for the avoidance of upstream jamming when the flow of grain exceeds its designed rate.

Still another object is to provide a gravity-fed grain cleaner, having access to its interior, of smaller size, lesser quantities of material, and lesser weight than prior cleaners.

A still further object is to provide total access to the interior of the casing of a gravity-fed grain cleaner from one side for inspecting, servicing and screen changing.

Yet another object of the invention is the provision of a light weight grain cleaner which requires less supporting structure for installation within gravity-fed systems.

Yet a further object is to provide an upright rectangular prism-shaped grain cleaner which is more compact and suitable for installation in tight spaces.

An additional object is the provision of a grain cleaner which can be a standard inventory unit for handling a variety of commodities requiring different pre-set flow rates which can be combined with other units for multiple installations or components of other gravity-fed systems.

These and other objects, advantages, and novel features of the present invention will become apparent from the following detailed description of the invention when considered in conjunction with the accompanying drawings.

DESCRIPTION OF THE PREFERRED EMBODIMENT

Figure 1:
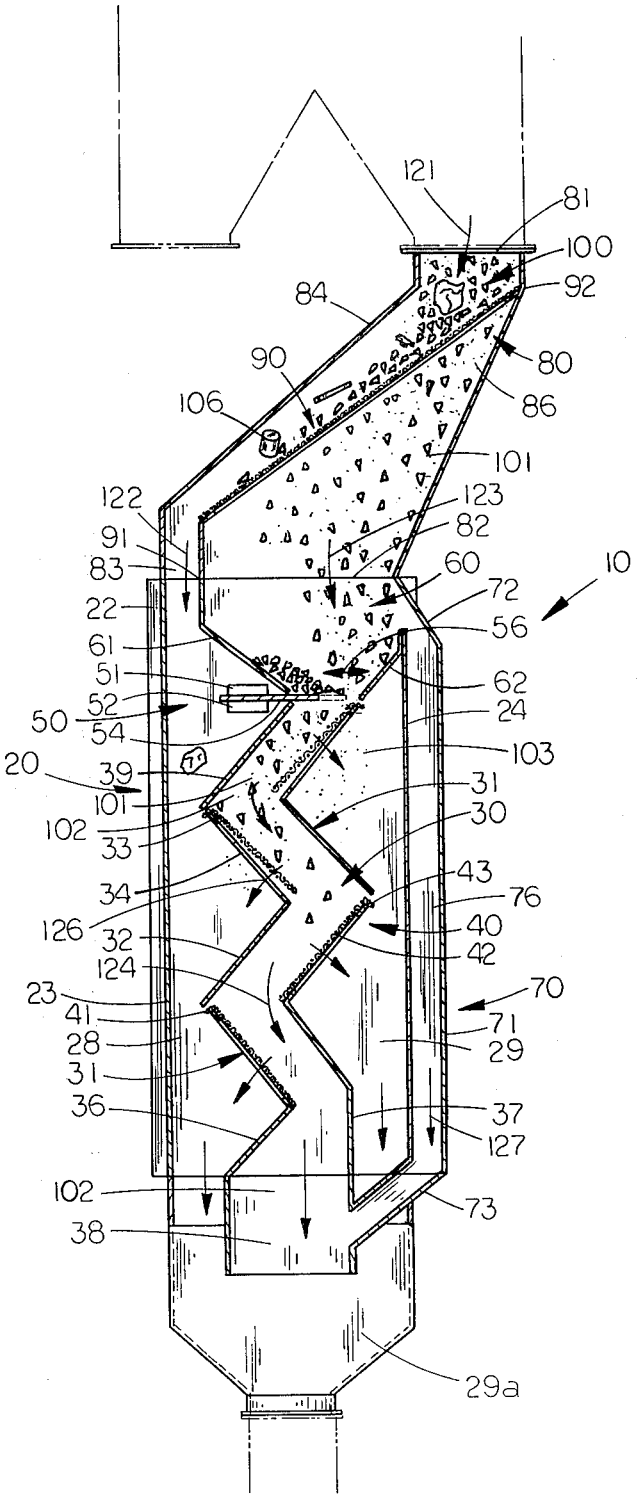
FIG. 1 is a front cross-sectional view of the apparatus installed in a gravity-flow system, other components thereof shown in phantom lines, taken along lines 1—1 of FIG. 2.

Referring now to the drawings wherein like reference numerals designate identical or corresponding parts throughout the several views, and more particularly to FIG. 1, whereon my apparatus for screening grain and the like 100 is designated generally at 10, its major components are a casing 20, a zig-zag chute 30, a plurality of resonating screen mechanisms 40 for separating clean material from fines, flow regulator 50, a receiving hopper 60, a by-pass 70, a delivery chute 80 and a coarse screen 90. Phantom lines above and below apparatus 10 in FIG. 1 indicate feed and discharge elements of any of various conventional gravity flow systems within which my apparatus 10 may be installed. Formed within casing 20 are chute 30, screen mechanisms 40, regulator 50 and hopper 60 to comprise a basic unitized cleaning apparatus. As casing 20 is of the general shape of an upright rectangular prism, this portion of the apparatus is useful as a standard inventory item for the manufacturer, being suitable for installation in multiples or with other components tailored to be joined with it. Flow regulator 50 adds a degree of flexibility for applications for different commodities as will be explained later.

Figure 2:
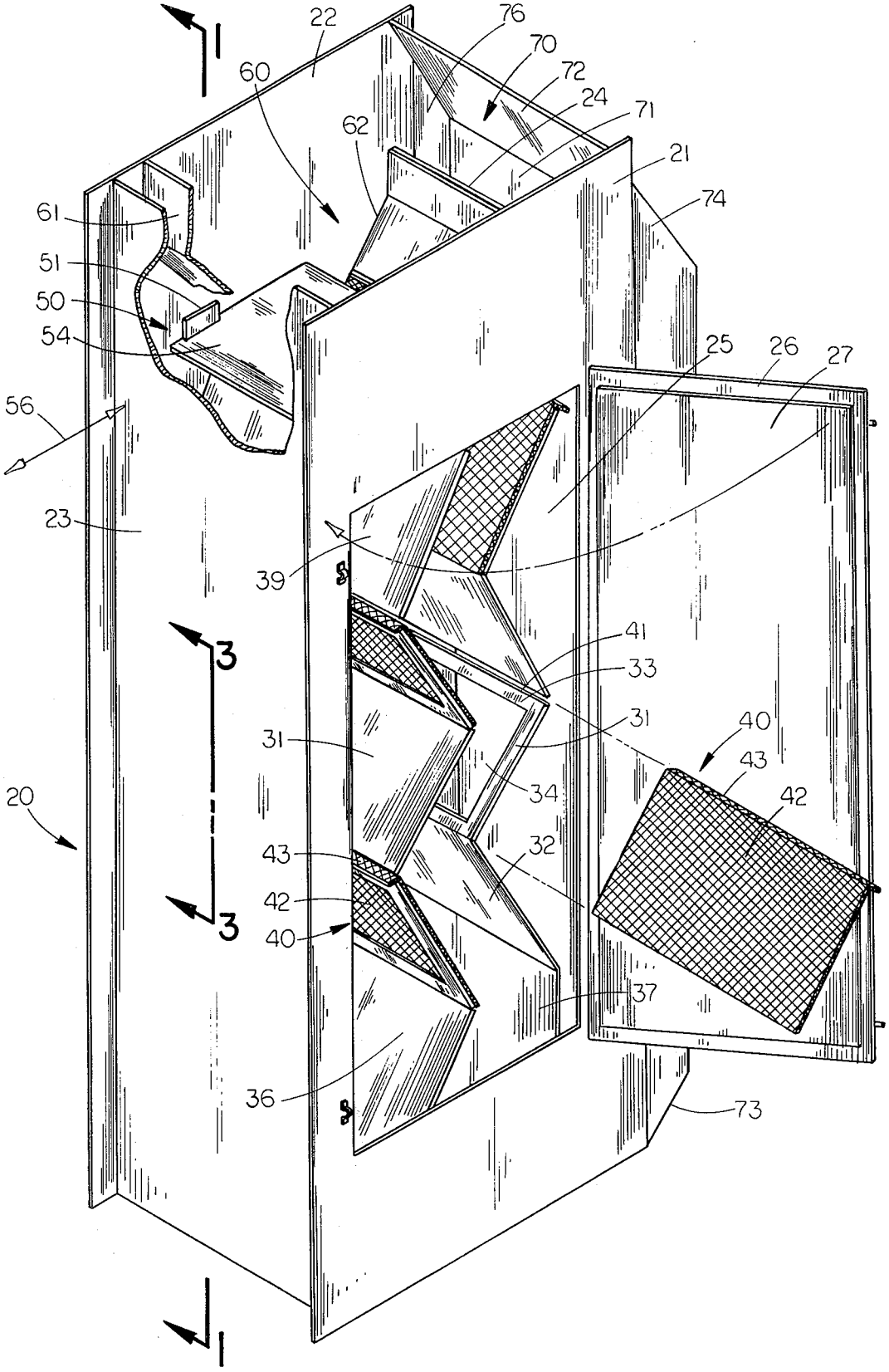
FIG. 2 is an enlarged front perspective view of the casing portion of the apparatus with a broken view into one side and with the access door open for a view into its interior.

Referring now to FIG. 2, casing 20 is seen to be constructed of four sheets of elongated rectangular material. One sheet forms front wall 21 and a sheet of equal size and shape forms rear wall 22. Connected near the edge of both front wall 21 and rear wall 22, normal thereto, and of equal width are left side wall 23 and right side wall 24 (see also FIG. 1). The bottoms of side walls 23 and 24 extend as far as the bottoms of front wall 21 and rear wall 22, and the top of left side wall 23 as far as their tops. The top of right side wall 24 extends to a point somewhat below the top of front wall 21 and rear wall 22. Front wall 21 has a large elongated rectangular opening 25 covering most of its area for access to the interior of casing 20 and a door 26 capable of operably closing in a well known manner in order to substantially enclose the casing 20 as though there were no opening 25. Furthermore, door 26 has a center portion 27, raised by the same thickness as front wall 21 and of a size and shape substantially equal to opening 25, whereby the inner surface of wall 21 will be effectively a single plane when door 26 is closed.

Figure 3:
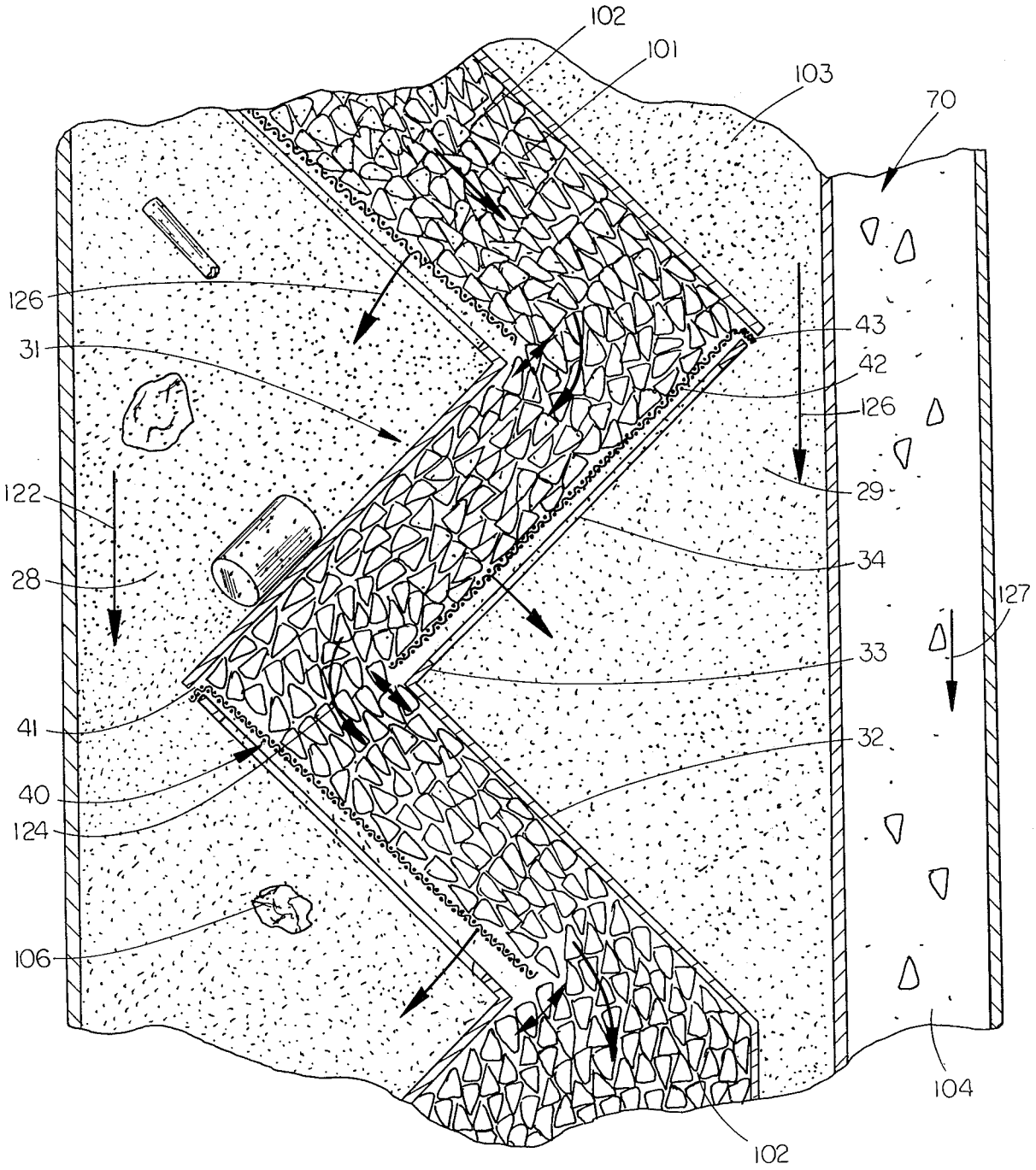
FIG. 3 is a super-enlarged partial cross-sectional view of the casing, zig-zag chute and by-pass of the apparatus, showing grain flowing therethrough, taken along line 3—3 of FIG. 2.

Referring now to FIGS. 1, 2 and 3, zig-zag chute 30 is comprised, in this embodiment, of four basic units 31 (see in particular unit 31 in FIG. 2 where a screen is depicted as having been removed). Basic unit 31 includes a lower rectangular element 32 having a horizontal dimension equal to the width of side walls 23 and 24, and an upper portion 33 of the same shape and size as lower portion 32 and affixed thereto, normally, along adjacent horizontal edges. Normal affixation between lower portion 32 and upper portion 33 is not essential to the functioning of the apparatus 10, other angles, either shallower or broader, also being suitable. Upper element 33 has a centered rectangular opening 34 dimensioned so as to create a narrow rectangular screen support out of upper element 33.

Each of the four basic units 31 are mounted inside of casing 20 along one of their vertical sides to rear wall 22. The juxtaposition of the four basic units 31 within casing 20 can be readily understood by referring to FIG. 1, whereon they can be seen to form a central vertical zig-zag chute within casing 20 having a constant cross section, having on the underside of each of its zigs and zags opening 34, and leaving along the left outside of two of the opening 34's on one side of zig-zag chute 30 a clear passageway 28 and along the right outside of the other two openings 34 a clear passageway 29. Both of the lower portions 32 on the left side and right side of zig-zag chute 30 have affixed thereto extension units 36 and 37, respectively, having horizontal dimensions equal to the width of left and right sides 23 and 24 and appropriately sized and oriented to direct the clean material 102 discharging from chute 30 to clean material discharge 38. Fitted around and beneath discharge 38 is fines confluent discharge *29a* which interconnects with clear passageways 28 and 29.

In addition, there is a special unit 39, rectangular in cross section, having a horizontal dimension equal to the width of left and right sides 23 and 24 which is mounted along one of its vertical sides to rear side 22 above the higher basic unit 31 forming the left side of zig-zag chute 30 at an orientation which will complete the upper zig-zag element of zig-zag chute 30. A slot 41 is functionally formed above each upper portion 34 of each basic unit 31 by leaving a slight space therebetween and the adjacent structural unit. The adjacent structural unit is two basic units 31 and simple unit 39 in three instances, the fourth being a portion of receiving hopper 60 which will be described below. The purpose of slot 41 will be set forth in the following paragraphs.

Referring again to FIG. 2, four resonating screen mechanisms 40 are each seen to have a screen element 42 which is rectangular in shape and which has substantially the same dimensions as upper portion 33 of basic unit 31. As will be more fully explained later, the size of the openings of screen elements 42 is such that the clean material 102 of the material to be screened 101 will remain within chute 30 and the fines 103 passing through screen mechanisms 40 will fall through clear passageways 28 and 29 to the bottom of casing 20 and then exit from confluent discharge *29a*. Depending normally from one horizontal edge of each screen element 42 is a strip 43 which, in this embodiment, is formed by a 90° bend in the screen material. As can be readily appreciated by referring to FIG. 2, screen element 42 along with strips 43 may be removably inserted, when access door 27 is open, into their operating positions by sliding strips 43 within slots 41.

Screen elements 42 are in their operating positions when they are resting flush against upper portions 33 of basic units 31. In this position, screen elements 42 are free to pivot upwardly within the interior of chute 30 about the upper horizontal edges of upper portions 33, being restricted only by the lower portions 32 of the adjacent basic units 31. Although it is not essential to my concept, it is anticipated that the distance between the planes of left and right side basic units 31 will be less than the heights of upper and lower portions 32 and 34. It should be apparent that this method of hingedly connecting screen mechanisms 40 within zig-zag chute 30 allows for quick, easy and efficient removal of screen elements 42 along with strips 43, either for changing to different sized screen elements 42, cleaning the screen elements or replacing damaged screen elements.

Referring now to both FIGS. 1 and 2, flow regulator 50 is located immediately above the upper horizontal edges of simple unit 39 and the highest basic unit 31. Upper and lower guide plates 51 and 52, respectively, are affixed to the inside surface of rear wall 22 towards the left side thereof in locations such as will form a horizontal guide 53 whose bottom is at the same elevation as the top of simple unit 39 and the top of the highest basic unit 31. Horizontal slide gate 54 is of the same width as left and right sides 23 and 24 and is slidably installed atop of simple unit 39 and guide plate 52. Its thickness is slightly less than the width of horizontal guide 53 and its elevation within casing 20 is maintained by guide plate 51.

As my apparatus 10 is suitable for cleaning various grains having different weight and volume characteristics, it is anticipated that gate 54 will be pre-set at the factory depending on what grain or commodity is to be cleaned. Generally, the other components of the gravity fed system within which it is connected are also geared to operate at a certain flow rate, such as 5,000 bushels per hour. Gate 54 would be set to constrict the area of the top of zig-zag chute 30 by whatever amount is required to be in phase with the particular product to be cleaned.

Referring again to FIGS. 1 and 2, receiving hopper 60 is seen to be formed of a left side wall 61 which is primarily rectangular and, in this embodiment, has a short upwards bend of 135°. Left side wall 61 has a horizontal dimension equal to the width of side walls 23 and 24 and the length of its longer height dimension is approximately equal to the distance from the top of gate 54 directly above simple unit 39 to a point, angling upwardly at 45° therefrom, somewhat short of left side wall 23. The 135° bending portion of left side wall 61 of hopper 60 extends to the top of front and rear walls 21 and 22 when left wall 61 of hopper 60 is affixed to the inner surfaces of the front and rear walls 21 and 22 at the location indicated by the above definition of its height dimensions.

Right side wall 62 of hopper 60 is of essentially the same configuration as left side wall 61, except that it is oriented in reverse within casing 20 in order that its 135° bend portion will coincide along its outside surface with the upper, inner surface of right side wall 24. Its longer height dimension is equal to a 45° downwardly angling distance to a point adjacent to the higher right side basic unit 31. That point is above said basic unit 31 far enough to allow adequate width to form a functioning slot 41 therewith. Right side wall 62 is affixed along its vertically oriented edges to front wall 21 and rear wall 22 and along its upwardly bent vertical portion to the upper, inner surface of right side wall 24. Receiving hopper 60 is thereby completely formed within casing 20 and above flow regulator 50.

As explained above, it is anticipated that flow regulator 50 will be factory pre-set for a given flow rate for a particular application. Any material 101 which accumulates in hopper 60 when apparatus 10 is charged at a higher rate will flow over right side hopper wall 62 and into by-pass 70. By-pass 70 directs overflow material 104 along the outside of casing 20 and long its bottom to where it joins with clean material discharge 38. By-pass 70 is formed by an exterior by-pass wall 71 which is spaced away from side wall 23 and parallel thereto, sloping exterior by-pass top wall 72, sloping exterior by-pass bottom wall 73, front by-pass side wall 74 (see FIG. 2), rear by-pass side wall 76 and the outer surface of side wall 23. These elements are interconnected in a well known manner to form by-pass 70 which will direct overflow from receiving hopper 60 therethrough to its connection with clean material discharge 38.

It should be apparent that it is possible to construct confluent fines discharge 29*a*, clean material dischage 38 and by-pass 70 of shapes which will accomplish the required interconnections below casing 20. When the material flow is above the pre-set rate of gate 54, a small quantity of unscreened material will by-pass chute 30 through by-pass 70. This alternative is preferable to the usual abuse of upstream components of a gravity flow system when jamming or stuffing occurs. The exterior dimensions of by-pass 70 are such that when added to the right side of casing 20 its general upright rectangular prism shape is not materially altered.

Again referring to FIG. 1 whereon delivery chute 80 is shown in cross section, it is seen to have a single opening 81 at its upper end for receiving gravity fed grain and the like 100, a first discharge opening 82 at its lower end for feeding into receiving hopper 60 material to be screened 101, and a second opening 83 also at its lower end for discharging large foreign matter 106. In the case of typical farm grain, foreign matter 106 may include such things as broken glass, corn cobs, beer cans and rocks.

Delivery chute 80 is inverted funnel-shaped with its upper opening 81 conformed to match and be connected with the conventional gravity flow system within which apparatus 10 is installed. Its first discharge opening 82 has a horizontal linear configuration which will sealably connect with the rectangle defined by the upper horizontal edge of hopper left side wall 61, sloping exterior by-pass top wall 72, and the portion of front and rear walls 21 and 22 contained therewithin. An inclined upper surface 84 of delivery chute 80 passes above the upper horizontal edge of hopper left side wall 61 a distance which defines the front and rear spacing of second discharge opening 83 (when considered to be oriented face-wise the same as casing 20). Upper surface 84 then turns downwards and, along with the front wall (not shown) and rear wall 86 of delivery chute 80 is extended to complete opening 83. Opening 83 connects with that portion of the top of casing 20 defined by the upper horizontal edges of left side 23, hopper left wall 61 and the portions of front wall 21 and rear wall 22 therebetween.

Coarse screen 90 extends through a section of delivery chute 80 which begins on the left at the conjoinment 91 of first opening 82 and second opening 83 and continues upwardly and across delivery chute 80 to a line 92 just below delivery chute receiving opening 81. Coarse screen 90 is of a size which will not permit large foreign matter 106 to flow therethrough and will permit the material to be screened 101 to enter receiving hopper 60. Accordingly, large foreign matter 106 will gravity feed into left clear passageway 28 where it mixes with and is discharged with fines 104 through confluent discharge 29*a*.

Having disclosed the structure of the present apparatus for cleaning grain and the like 100, its functioning will now be described. Referring to FIGS. 1 and 3, arrow 121 shows the direction of flow of a commodity, such as husked corn, entering through opening 81 of grain receiving chute 80. Arrow 122 indicates that large foreign matter 106 will flow into passageway 28 and arrow 123 shows the material to be screened 101 entering hopper 60. Arrows 124 show the path of clean corn 102 which fails to pass through any screen 42 flowing through zig-zag chute 30 and, subsequently, out clean material discharge 38. Arrows 126 depict the path of fines 103 flowing through screens 42 into both passageways 28 and 29 and, subsequently, out through fines confluent discharge 29*a*. The path of material to be screened 101 which may overflow from receiving hopper 60 through by-pass 70 and, subsequently, beneath casing 20 into clean material discharge 38 is indicated by arrow 127.

As a consequence of the flow of the husked corn, as in this example, through apparatus 10, screens 42 are caused to vibrate rapidly above upper portion 33 of basic unit 31 and about slot 41, thereby further agitating the material to be screened 101 as it passes from receiving hopper 60. Fines 103 join foreign matter 106 in left passageway 28 and pass on through fines confluent 29*a* after having joined with fines exiting from right passageway 29. In some situations, as explained above, a portion of material to be screened 104 will travel through by-pass 70 through clean material discharge 38, joining clean corn 102.

Although many materials which are well known may be used to fabricate the apparatus 10, a lightweight but strong unit may be constructed of basic materials universally available. These materials are angle-iron, 10 gauge steel, high carbon woven wire, steel strap, and standard nuts and bolts.

Having hereby disclosed the subject matter of this invention, it should be obvious that many modifications, substitutions, and variations of the invention are possible in light of the above teachings. It is therefore to be understood that the invention may be practised other than as specifically described, and should be limited only by the breadth and scope of the appended claims.

I claim:

1. An apparatus for screening grain or the like comprising:

a casing;

means for forming a vertical zig-zag chute within the casing for receiving gravity fed material to be screened, the underside of each zig and each zag having an opening for the passage of material therethrough to the bottom of the casing and the upperside thereof being of fixed angular relationship with respect to the walls of the casing;

means for hingedly connecting to the interior of said chute forming means, above each opening therein, a screen covering the opening whereby clean elements of the material to be screened will follow a zig-zag path through said chute forming means and cause each screen to resonate with respect to said hingedly connecting means, thereby further separating the fines therefrom, and whereby the clean elements will be discharged from said chute forming means and the fines from said casing.

2. The apparatus for screening grain or the like as described in claim 1 wherein said zig-zag chute forming means is further characterized as including:

a left zig-zag side extending between opposite walls of said casing, each zig and zag being planar; and a right zig-zag side extending between opposite walls of said casing, each zig and each zag being planar, parallel to a respective left side zig and zag, and each being at the same distance therefrom.

3. The apparatus for screening grain or the like as described in claim 2 wherein the underside of each zig and each zag of said chute forming means is further characterized as having above each opening therein a horizontal linear slot and said hingedly connecting means is further characterized as including a horizontal linear strip depending from each screen for mating said strip within the slot and the screen over the respective opening, whereby the screen is removably, hingedly connected solely by gravity.

4. The apparatus for screening grain or the like as described in claim 3 wherein each slot is further characterized as extending to a single one of the walls between which the right and left zig-zag sides extend and wherein said wall is further characterized as having access for allowing the slidable removal of each screen and depending strip and said wall further includes an operable access door.

5. The apparatus for screening grain or the like as described in claim 4, further comprising:

a substantially horizontal sliding gate supported within said casing which may be selectively set to constrict the opening within the top of said zig-zag chute forming means;

means for forming a hopper within said casing for receiving the gravity fed material to be screened, located above said sliding gate and discharging into said zig-zag chute forming means;

means for by-passing said zig-zag chute forming means by material over-flowing the hopper forming means and reintroducing it into the bottom of said casing outside of said zig-zag chute forming means, wherein said casing is generally in the shape of an upright rectangular prism and said by-passing means is principally in the shape of an elongated flat rectangular prism, its width and height being flush with the width and height of a wall of said casing which is normal to said wall having access to the screens;

means for forming onto the top of said casing a delivery chute for receiving gravity fed grain or the like, having a first opening connected to the top of said hopper forming means and a second opening connected to the casing adjacent the hopper forming means on the side of said casing opposite said by-passing means; and a coarse screen within the delivery chute forming means and intersecting it at a cross-section which begins between the first and second openings thereof and slopes upwards to the opposite side of the delivery chute forming means whereby large foreign matter will be discharged through the second opening into the casing and the material to be screened will be discharged through the first opening into the hopper forming means.

6. The apparatus for screening grain or the like as described in claim 1 further comprising:

a substantially horizontal sliding gate supported within said casing which may be selectively set to constrict the opening within the top of said zig-zag forming means;

means for forming a hopper within said casing for receiving the gravity fed material to be screened, located above said sliding gate and discharging into said chute forming means; and means for by-passing said chute forming means by material over-flowing the hopper forming means and reintroducing it into the bottom of said casing outside of said chute forming means.

7. The apparatus for screening grain or the like as described in claim 6 wherein said casing is generally in the shape of an upright rectangular prism and said by-passing means is principally in the shape of an elongated flat rectangular prism, its width and height being flush with the width and height of said casing.

8. The apparatus for screening grain or the like as described in claim 7 further comprising:

means for forming onto the top of said cashing a delivery chute for receiving gravity fed grain or the like, having a first opening connected to the top of said hopper forming means and a second opening connected to the casing adjacent the hopper forming means on the side of said casing opposite said by-passing means; and a coarse screen within the delivery chute forming means and intersecting it at a cross-section which begins between the first and second openings thereof and slopes upwards to the opposite side of the delivery chute forming means whereby large foreign matter will be discharged through the second opening into the casing and the material to be screened will be discharged through the first opening into the hopper forming means.

* * * * *